United States Patent [19]

Frost

[11] 4,328,755

[45] May 11, 1982

[54] HAND GRENADE WITH WAVE-FORMING MEANS BETWEEN CHAMBERS

[75] Inventor: John J. Frost, Kraainem, Belgium

[73] Assignee: Oregon Etablissement für Patentverwertung, Austria

[21] Appl. No.: 59,626

[22] Filed: Jul. 23, 1979

[30] Foreign Application Priority Data

Jul. 25, 1978 [IT] Italy ..... 68771 A/78

[51] Int. Cl.[3] ..... F42B 27/08

[52] U.S. Cl. ..... 102/486; 102/487; 102/492

[58] Field of Search ..... 102/64, 65, 65.2, 65.4, 102/67, 68, 482, 483, 484, 485, 486, 487, 488, 305, 306, 307, 309, 311, 492

[56] References Cited

U.S. PATENT DOCUMENTS

| | | | |
|---|---|---|---|
| 1,225,884 | 5/1917 | Steinmetz . | |
| 2,144,554 | 1/1939 | Sthyr | 102/486 |
| 2,457,817 | 1/1949 | Harrell | 102/68 |
| 3,103,171 | 9/1963 | Jans | 102/487 |
| 3,611,932 | 10/1971 | Clator | 102/305 |
| 3,705,552 | 12/1972 | Lerman | 102/64 |

FOREIGN PATENT DOCUMENTS

| | | |
|---|---|---|
| 1134003 | 7/1962 | Fed. Rep. of Germany . |
| 2142632 | 2/1973 | France . |
| 2344808 | 10/1977 | France . |

*Primary Examiner*—Peter A. Nelson
*Attorney, Agent, or Firm*—McGlew and Tuttle

[57] ABSTRACT

A hand grenade whose interior is divided into two chambers receiving the explosive charge, said chambers being superjacently arranged and open in respect of each other, whereby the detonation wave originating from the detonator in the lower of said two chambers is influenced.

16 Claims, 1 Drawing Figure

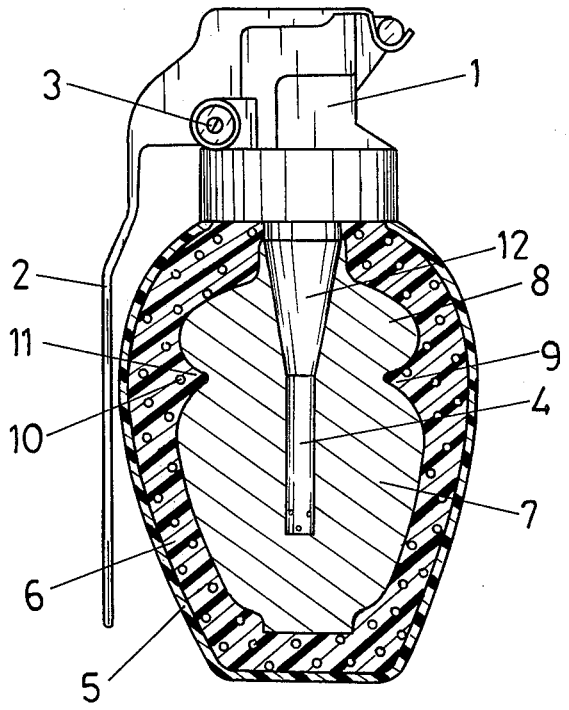
3
1
12
2
8
11
9
4
10
7
6
5

HAND GRENADE WITH WAVE-FORMING MEANS BETWEEN CHAMBERS

BACKGROUND OF THE INVENTION

1. Field of the Invention

The invention relates to a hand grenade having a fragmentation body and a detonator head from which a detonator tube with the detonator projects into the lower half of the interior of the fragmentation body, which is filled with explosive.

2. Description of the Prior Art

The fragmentation body of a hand grenade is usually a cast iron member of a plastics material member with embedded metal particles. As a result of detonation of the explosive charge which is disposed in the interior of the fragmentation body of the hand grenade, the fragmentation body is broken up and the fragments or the metal particles embedded in the fragmentation body are scattered. The breaking-up of the fragmentation body, or the energy which is imparted to the fragments or to metal particles embedded in plastics material, is not usually distributed uniformly over the fragmentation body. It would in fact be possible to achieve approximately uniform scatter of the fragments or metal particles, with a spherical fragmentation body, if detonation of the explosive charge begins at the middle of the sphere, that is to say, the middle of the sphere is at the same time the detonation firing point. In this case, the spherical wave front of the detonation wave originating from the detonation firing point would reach all points on the spherical inside surface of the fragmentation body simultaneously and would there convert its energy uniformly over the spherical surface of the fragmentation body, which results in the fragments or metal particles being scattered uniformly in all directions. In practice however, hand grenades are not of a spherical configuration in most cases, but are approximately egg-shaped as this shape is more manageable than the spherical shape, for a hand grenade of larger volume. In particular in such approximately egg-shaped hand grenades, the detonation firing point is not at the centre of the explosive-filled interior of the fragmentation body, but in most cases is in the lower half of the interior of the hand grenade, at a position remote from the detonator head, for it is in the lower half of the interior of the hand grenade that the detonator is located, in the detonator tube which is connected to the detonator head.

Initiation of the explosive charge is effected from the detonator. In such a hand grenade, the spherical wave front of the detonator wave whose centre (detonation firing point) is in the lower half of the interior of the hand grenade first reaches the lower regions of the fragmentation body so that the lower region of the fragmentation body is preferentially broken up, while fragments or metal particles are scattered at a lower energy level in the upper region of the fragmentation body, in particular the "neck region" or "shoulder region" around the detonator head.

SUMMARY OF THE INVENTION

It is therefore an object of the present invention to provide a hand grenade whose fragmentation body is broken up as uniformly as possible upon detonation of the explosive charge so that fragments or metal particles are scattered as uniformly as possible over the entire surface of the fragmentation body, which finally results in an improvement in the fragment penetration capacity of the hand grenade.

According to the invention, this is achieved in that the interior chamber substantially surrounded by the fragmentation body of the hand grenade is divided into two chambers superjacently arranged and in open communication in respect of each other of which the lower chamber extends at least over half the height, that is, length, of the interior chamber of the hand grenade and has side walls which are curved in the same direction and which project inwardly at their upper edge in the form of an annular rib, wherein the annular rib defines a cross-sectional constriction in the interior chamber of the hand grenade, intermediate the length of the interior chamber, between the upper and lower chambers.

Detonation of the explosive charge which is in the interior of the hand grenade between the detonator tube and the fragmentation body originates from the detonator at the lower end of the detonator tube, when the hand grenade is detonated, and causes a detonation wave to be propagated in the lower chamber of the hand grenade. This detonation wave is propagated at least approximately normal to the inside wall of the fragmentation body in the region of the lower chamber, and results in intensive scatter of the fragments or metal particles of the fragmentation body in the region of the lower chamber. For the above-described propagation of the detonation wave in the lower chamber of the interior of the hand grenade, it is desirable for the diameter of the lower chamber to be of approximately the same dimension as the height of the lower chamber.

Because the interior of the hand grenade is divided according to the invention into two chambers, and because of the annular rib which separates the two chambers, in conjunction with the surface of the detonation tube the detonation wave is influenced in such a way that a wave front is also formed in the chamber above the annular rib, which wave front is propagated as perpendicularly as possible relative to the inside wall of the hand grenade body (fragmentation body). The detonation wave originates from the detonation firing point in the region of the detonating cap, is reflected at the annular rib, which acts, so-to-speak, as a wave forming means, between the upper and lower chambers of the interior of the hand grenade, and is projected by the detonator tube against the inside wall of the upper chamber of the hand grenade body, whereby the region of the fragmentation body ("neck or shoulder region") which is disposed around the detonator body is also broken up and the fragments or metal particles in this region are scattered intensively.

The effect according to the invention is particularly influenced by the height of the lower chamber in relation to the overall height of the interior of the fragmentation body or in relation to the height of the upper chamber. Particularly favourable results are attained if the lower chamber extends approximately over two thirds of the overall height of the interior of the hand grenade, or the upper chamber extends over approximately one third of the overall height of the interior of the hand grenade.

A further influence on the effect according to the invention, specifically on the propagation of the detonation wave in the upper chamber in the interior of the hand grenade, is also exerted by the shape of the annular rib which separates the lower chamber from the upper chamber in the interior of the hand grenade. It is advantageous for the rib to be of an approximately triangular cross-section. The triangular cross-sectional configuration of the annular rib is preferably symmetrical with respect to the plane of separation between the upper and lower chambers, and is therefore in the form of an equilateral triangle. The side surfaces of the rib, which are towards the upper and the lower chambers, are advantageously of concave curvature.

Furthermore, for achieving the desired propagation of the detonation wave in the upper chamber of the fragmentation body, it is advantageous for the constriction formed by the annular rib so as to have a circular cross-section, has a diameter which is greater than half the inside diameter of the circular cross-section of the upper or lower chamber respectively, which not only provides that propagation of the detonation wave from the lower into the upper chamber is not prevented but also avoids (in conjunction with the feature of the triangular cross-sectional shape of the annular rib) an excessive concentration of mass in the region of the annular rib, and thus non-uniform fragmentation scatter.

Finally, the shape of the detonator tube also influences the effect according to the invention. It is advantageous for the detonator tube to be of a tapered configuration in the region of the upper chamber of the hand grenade, in such a way that the outside diameter of the detonator tube increases conically in an upward direction. Thereby a central, conical reflection wall for the detonation wave is formed in the region of the upper chamber, said wall being coaxial to the axis of the hand grenade and tapered in the downward direction.

The feature according to the invention that the lower chamber has side walls which are curved in the same direction is intended to prevent the detonation wave being dispersed at the side walls of the lower chamber. However, the side walls may show minor deviations from the construction with curvature in the same direction, such as for example moulding projections for producing the fragmentation body by injection moulding.

The effect according to the invention occurs in a particularly clear manner in a hand grenade in which the fragmentation body comprises a multiplicity of individual metal particles which are preferably embedded in a carrier layer of plastics material.

BRIEF DESCRIPTION OF THE DRAWING

The invention is described in greater detail by means of an embodiment with reference to the drawing, without being restricted to this embodiment.

The drawing shows a hand grenade, with the detonator head and the detonator tube in side view, but with the hand grenade body in vertical longitudinal section.

DESCRIPTION OF THE PREFERRED EMBODIMENT

The hand grenade shown in the drawing has a detonator head 1 to which a safety lever 2 is fixed and secured by a pin 3. The safety lever 2 holds a striker (not visible in the drawing) in a stressed position. A detonator tube 4 is connected to the detonator head 1 by a screw connection, and includes (as viewed in a downward direction) a primer capsule, a delay composition and a heat-ignited detonator.

The hand grenade body shown in cross-section in the drawing comprises an outer casing 5 of impact-resistant plastics material, for example polyethylene, and a non-spherical elongated fragmentation body 6 of plastics material, for example polystyrene with metal particles embedded therein. The interior chamber of the fragmentation body 6 is filled with explosive, for example TNT, PETN or the like.

According to the invention, the interior of the hand grenade is divided into two chambers 7 and 8. The lower chamber 7 has substantially smooth side walls which are curved in the same direction. This also applies, in the embodiment illustrated, in regard to the upper chamber 8. The two chambers 7 and 8 are separated a cross-sectional construction intermediate the length of the interior chamber, characterized by the side walls of the lower chamber 7 projecting inwardly at their upper edge, in the form of an annular rib 9, which defines a periphery about the constricted opening that establishes communication between the upper and lower chambers.

In the embodiment illustrated, the lower chamber 7 extends over two thirds of the height, that is, the length of the elongated interior chamber of the hand grenade. Accordingly, the vertical dimension of the upper chamber is one third of the height of the interior of the hand grenade.

In the embodiment illustrated, the annular rib 9 which separates the lower chamber 7 from the upper chamber 8 is of an approximately triangular cross-sectional shape, while the side surfaces 10 and 11 which face towards the lower chamber 7 and the upper chamber 8 have a slight concave curvature.

The lower portion of the detonator tube 4, which contains the detonating cap, projects into the lower chamber 7, so that the detonation firing point is approximately at the centre of the lower chamber 7. In the region of the upper chamber 8, the detonator tube 4 is of a conical outside configuration, which is formed by a cone portion 12 of wood or plastics material, for example polyethylene, which tapers in a downward direction and which is pushed on to the otherwise cylindrical detonator tube 4.

It has been found that with a hand grenade as in the illustrated embodiment, on the basis of the technical affect described in the preamble to this description, it was possible for the fragmentation penetration capacity of the hand grenade to be increased by more than 10%, in comparison with a hand grenade of conventional structure with the same explosive charge and the same number of metal particles embedded in the fragmentation body.

What is claimed is:

1. An improved hand grenade having a non-spherical elongated fragmentation body substantially surrounding an elongated interior chamber, an explosive within the interior chamber, a detonator head and a detonator tube connected to the detonator head, wherein the improvement comprises the interior chamber being formed with a cross-sectional constriction intermediate the length thereof with an annular rib sub-dividing the chamber into an upper chamber and a lower chamber so as to act as a wave-forming means between said upper and lower chambers, said upper chamber being superjacently arranged above and communicating with the lower chamber, said lower chamber having a length of at least half the length of the elongated interior chamber, said lower chamber having a curved side wall which projects inwardly at its upper end to form said annular rib, and wherein the detonation tube is extended from the detonator head through the upper chamber into the lower chamber.

2. An improved hand grenade according to claim 1, wherein said lower chamber has a length equal to approximately two thirds of the length of the elongated interior chamber of the hand grenade.

3. An improved hand grenade according to claim 1 or 2, wherein said annular rib between said lower chamber and said upper chamber has a triangular cross-section.

4. An improved hand grenade according claim 3, wherein said annular rib has faces which are directed one toward said lower chamber and the other toward said upper chamber, and said faces have a concave curvature.

5. An improved hand grenade according to claims 1 or 2, wherein said constriction has a circular cross-section and said upper chamber has a circular cross-section, the circular cross-section of the constriction having a diameter which is greater than half the maximum inside diameter of said upper chamber.

6. An improved hand grenade according to claim 3, wherein said constriction has a circular cross-section and said upper chamber has a circular cross-section, the circular cross-section of the constriction having a diameter which is greater than half the maximum inside diameter of said upper chamber.

7. An improved hand grenade according to claim 4, wherein said constriction has a circular cross-section and said upper chamber has a circular cross-section, the circular cross-section of the constriction having a diameter which is greater than half the maximum inside diameter of said upper chamber.

8. An improved hand grenade according to claims 1 or 2, wherein said constriction has a circular cross-section and said lower chamber has a circular cross-section, the circular cross-section of the constriction having a diameter which is greater than half the maximum diameter of said lower chamber.

9. An improved grenade according to claim 3, wherein said constriction has a circular cross-section and said lower chamber has a circular cross-section, the circular cross-section of the constriction having a diameter which is greater than half the maximum diameter of said lower chamber.

10. An improved grenade according to claim 4, wherein said constriction has a circular cross-section and said lower chamber has a circular cross-section, the circular cross-section of the constriction having a diameter which is greater than half the maximum diameter of said lower chamber.

11. An improved hand grenade according to claim 1 or 2, wherein the detonator tube has a portion located in said upper chamber that has a tapered configuration with an outside surface increasing conically in an upward direction.

12. An improved hand grenade according to claim 4, wherein the detonator tube has a portion located in said upper chamber that has a tapered configuration with an outside surface increasing conically in an upward direction.

13. An improved hand grenade according to claim 11, in which said tapered portion comprises a conical plastic member and a cylindrical detonator tube portion over which said conical plastic member is engaged.

14. An improved hand grenade according to claim 1, in which both in the region of said lower chamber and in the region of said upper chamber, the fragmentation body comprises a plurality of individual metal fragments embedded in a carrier layer.

15. An improved hand grenade according to claim 14, in which the carrier layer is formed of a plastic material.

16. An improved hand grenade having a non-spherical elongated fragmentation body substantially surrounding an elongated interior chamber, an explosive filled within the interior chamber, a detonator head and a detonator tube connected to the detonator head, wherein the improvement comprises the interior chamber being formed with a cross-sectional constriction intermediate the length thereof with an inwardly projected annular rib sub-dividing the chamber into an upper chamber and a lower chamber on opposite sides thereof so as to act as a wave-forming means between said upper and lower chamber, said upper chamber being superjacently arranged above and communicating with the lower chamber, said lower chamber having a length of at least half the length of the elongated interior chamber, said lower chamber having a curved side wall which projects inwardly at its upper end to form said annular rib, and wherein the detonation tube is extended from the detonator head through the upper chamber into the lower chamber so that the detonation firing point is approximately at the center of the lower chamber.

* * * * *

UNITED STATES PATENT AND TRADEMARK OFFICE

CERTIFICATE OF CORRECTION

PATENT NO. : 4,328,755

DATED : May 11, 1982

INVENTOR(S) : John J. Frost

It is certified that error appears in the above-identified patent and that said Letters Patent is hereby corrected as shown below:

On the title page item [73] assignee:

delete "Austria" and insert --Mauren, Liechtenstein--.

Signed and Sealed this

*Thirtieth* Day of *November 1982*

[SEAL]

*Attest:*

GERALD J. MOSSINGHOFF

*Attesting Officer* *Commissioner of Patents and Trademarks*